US005944966A

United States Patent [19]

Suetsugu et al.

[11] Patent Number: 5,944,966

[45] Date of Patent: Aug. 31, 1999

[54] LOW HYDROGEN OVERVOLTAGE CATHODE AND PROCESS FOR PRODUCTION THEREOF

[75] Inventors: Kazumasa Suetsugu; Kazuhisa Yamaguchi; Kanji Yoshimitsu; Takashi Sakaki, all of Yamaguchi, Japan

[73] Assignee: Tosoh Corporation, Shinnanyo, Japan

[21] Appl. No.: 08/992,457

[22] Filed: Dec. 17, 1997

[30] Foreign Application Priority Data

| | | | |
|---|---|---|---|
| Dec. 17, 1996 | [JP] | Japan | 8-336996 |
| Apr. 8, 1997 | [JP] | Japan | 9-089535 |
| Jun. 13, 1997 | [JP] | Japan | 9-157064 |
| Oct. 3, 1997 | [JP] | Japan | 9-271006 |

[51] Int. Cl.[6] ..... C25B 11/00

[52] U.S. Cl. ..... 204/290 R; 204/290 F; 204/293; 205/57; 205/152; 205/236; 205/237; 205/255; 205/256

[58] Field of Search ..... 204/290 R, 290 F, 204/293; 429/218.2, 59, 101, 223; 420/900; 205/57, 152, 236, 237, 255, 256

[56] References Cited

U.S. PATENT DOCUMENTS

| | | | |
|---|---|---|---|
| 4,465,580 | 8/1984 | Kasuya | 204/290 R |
| 4,801,368 | 1/1989 | Yamashita et al. | 204/293 |

FOREIGN PATENT DOCUMENTS

| | | |
|---|---|---|
| 2384036 | 10/1978 | France . |
| 31 02 306 | 1/1982 | Germany . |
| 31 32 269 | 5/1982 | Germany . |

OTHER PUBLICATIONS

Database WPI 3/82, Derwent Publications Ltd., London, GB; AN 82–30103, XP002056840.

Database WPI 5/82, Derwent Publications Ltd., London, GB; AN 82–40559, XP002056841.

*Primary Examiner*—Bruce F. Bell

*Attorney, Agent, or Firm*—Oblon, Spivak, McClelland, Maier & Neustadt, P.C.

[57] ABSTRACT

A novel cathode of low hydrogen overvoltage is provided which is useful for electrolysis of water and electrolysis of an aqueous alkali metal chloride such as sodium chloride. A process for producing the cathode is also provided. The low hydrogen overvoltage cathode comprises an electroconductive base material; and a coating layer containing at least one organic compound selected from the group consisting of amino acids, monocarboxylic acids, dicarboxylic acids, monoamines, diamines, triamines, and tetramines, and derivatives thereof at a content of from 0.5% to 18% by weight in terms of carbon, and a metal component selected from the group consisting of nickel, nickel-iron, nickel-cobalt, and nickel-indium at an indium content ranging from 1% to 90% by weight. The process for producing the low hydrogen overvoltage cathode comprises conducting electrodeposition to form a coating layer on a surface of an electroconductive base material in a plating bath containing at least nickel ions, nickel and iron ions, nickel and cobalt ions, or nickel and indium ions, and containing additionally at least one organic compound selected from the group consisting of amino acids, monocarboxylic acids, dicarboxylic acids, monoamines, diamines, triamines, and tetramines, and derivatives thereof.

12 Claims, No Drawings

LOW HYDROGEN OVERVOLTAGE CATHODE AND PROCESS FOR PRODUCTION THEREOF

BACKGROUND OF THE INVENTION

1. Field of the Invention

The present invention relates to a cathode for electrolysis of water or of an aqueous solution of an alkali metal chloride such as sodium chloride, and having sufficiently low hydrogen overvoltage characteristics. The present invention relates also to a process for producing the cathode.

2. Description of the Related Art

The industry of water electrolysis or aqueous alkali metal chloride electrolysis consumes a large amount of electric power. Various techniques therefore are being developed for energy-saving. The energy saving can be achieved by substantial reduction of the electrolysis voltage which depends on theoretical electrolysis voltage, solution resistance, diaphragm resistance, anode overvoltage, cathode overvoltage, and so forth. The overvoltage, which is affected greatly by the electrode material and the electrode surface state, attracts attention of many scientists, and many techniques have been developed therefore. In the ion-exchange process for sodium chloride electrolysis, concerns are concentrated to the reduction of the anode overvoltage, and comprehensive researches and developments have been made. Consequently, anodes have been completed which have sufficient durability and involve few problems of overvoltage are almost solved. The anodes are employed widely at the moment.

On the other hand, many studies have been made also for reduction of the cathode overvoltage. For the iron cathode having hydrogen overvoltage of 400 mV, electrodes are disclosed which reduces the overvoltage by 200–250 mV from the overvoltage of the iron electrode. For example, JP-A-59-25940 and JP-A-6-146046 disclose electrodes having a hydrogen absorbing alloy or a platinum group oxide deposited on the surface of an electrode base material. JP-B-40-9130 discloses an electrode having an alloy of a transition metal such as iron, cobalt, and nickel with tungsten or molybdenum electroplated on the surface of the electrode base material.

However, the aforementioned electrode having a hydrogen absorbing alloy or a platinum group oxide deposited thereon is costly owing to expensiveness of the material, whereas the electrode coated with an alloy of the latter patent is not satisfactory in reducing the hydrogen overvoltage.

After comprehensive investigations to solve the above problem, the present invention has been accomplished.

SUMMARY OF THE INVENTION

An object of the present invention is to provide a cathode having satisfactorily low hydrogen voltage in electrolysis of water or an aqueous alkali metal chloride solution.

Another object of the present invention is to provide a process for producing the above cathode.

The low hydrogen overvoltage cathode of the present invention comprises an electroconductive base material; and a coating layer containing at least one organic compound selected from the group consisting of amino acids, monocarboxylic acids, dicarboxylic acids, monoamines, diamines, triamines, and tetramines, and derivatives thereof at a content ranging from 0.5% to 18% by weight in terms of carbon, and a metal component selected from the group consisting of nickel, nickel-iron, nickel-cobalt, and nickel-indium containing indium at an indium content ranging from 1% to 90% by weight. The derivative of the organic compound herein includes dimers and polymers of the organic compound and denatured products such as decomposition products thereof. The above amount of the carbon by weight is the average over the entire surface of the cathode.

The process for producing the low hydrogen overvoltage cathode comprises conducting electrodeposition to form a coating layer on a surface of an electroconductive base material in a plating bath containing at least nickel ions, nickel and iron ions, nickel and cobalt ions, or nickel and indium ions, and containing further at least one organic compound selected from the group consisting of amino acids, monocarboxylic acids, dicarboxylic acids, monoamines, diamines, triamines, and tetramines, and derivatives thereof.

DETAILED DESCRIPTION OF THE PREFERRED EMBODIMENT

The electrode of the present invention can relatively readily be produced by conducting electrodeposition to form a coating layer on a surface of an electroconductive base material in a plating bath containing at least nickel ions, nickel and iron ions, nickel and cobalt ions, or nickel and indium ions, and containing further at least one organic compound selected from the group consisting of amino acids, monocarboxylic acids, dicarboxylic acids, monoamines, diamines, triamines, and tetramines, and derivatives thereof.

The electroconductive base material includes nickel, iron, copper, titanium, stainless steel and other materials resistant against caustic alkali. The shape of the electroconductive base material is not specially limited, and is generally in a shape adapting to the cathode of the electrolytic cell: for example, in a shape of a flat plate, a curved plate, an expanded metal, a punched metal, a net, and a perforated plate.

The surface of the electroconductive base material is preferably subjected to usual pretreatment such as degreasing and etching prior to the electroplating. The electroconductive base material may effectively be plated with nickel or nickel-sulfur, or treated for deposition of fine particulate electroconductive material such as carbon particles and platinum group element particles for roughening the base material surface, to strengthen the adhesion of the alloy layer to the base material.

The counter electrode for the electroplating is not specially limited, and includes insoluble electrodes such as platinum electrodes and platinum-coated titanium plate; and soluble electrodes such as nickel plates, iron plates, and nickel-iron alloy plates.

The thickness of the electrodeposition layer is preferably in the range from 20 to 300 $\mu$m, since a smaller layer thickness does not give the desired low hydrogen overvoltage performance and a larger layer thickness is liable to cause exfoliation of the layer.

The source of the metal of nickel, iron, cobalt, or indium contained in the plating bath is not specially limited, and includes conventionally used metal salts such as chlorides, sulfates, sulfamates, and citrates, and mixtures thereof.

The organic compound to be added to the plating bath includes amino acids such as glycine, α-alanine, β-alanine, histidine, proline, valine, aspartic acid, glutamic acid, lysine, arginine, serine, and threonine; monocarboxylic acids such as acetic acid, propionic acid, butyric acid, valeric acid, acrylic acid, and crotonic acid; dicarboxylic acids such as malonic acid, succinic acid, glutaric acid, adipic acid, pimelic acid, suberic acid, azelaic acid, and sebacic acid; and monoamines, diamines, triamines, and tetramines such as propylamine, butylamine, amylamine, hexylamine, heptylamine, dibutylamine, tributylamine, cyclopropylamine, cyclobutylamine, cyclohexylamine, ethylenediamine, propylenediamine, butylenediamine, heptamethylenediamine, hexamethylenedi amine, diethylenetriamine, dipropylenetriamine, triethylenetetramine, and tripropylenetetramine. The organic compound is used in an amount within the solubility thereof, and preferably in the range of from 0.1 to 3 moles relative to the nickel ion concentration in the plating bath. Further, a conventional pH buffering agent or a conventional electroconductive agent such as ammonium citrate, sodium citrate, potassium citrate, ammonium chloride, and boric acid may be added to the plating bath.

The pH of the plating bath should be in the range for dissolution of the additives. A lower pH tends to lower the electroplating current efficiency, whereas a higher pH tends to lower the adhesiveness of the electrodeposited layer. Therefore, optimum pH should be selected corresponding to the used additives. The chemical for pH adjustment is not specially limited, and includes inorganic acid such as sulfuric acid and hydrochloric acid; organic acid salts such as citrate, and tartarate; sodium hydroxide; and aqueous ammonia.

The temperature of the plating bath is preferably not higher than the boiling point of the organic compound used, and is generally in the range from 20° C. to 80° C. At a temperature lower than this range, the plating efficiency is lower uneconomically, whereas at a temperature higher than this range, the forced alloy layer is brittler.

The plating current density is not specially limited. At a lower current density, the plating speed tends to drop, whereas at a higher current density the plating efficiency is lowered and leads to less productivity. At a much higher current density, the additive tends to be oxidized and decomposed at the anode side to cause loss of the additive. Therefore, the current density is preferably selected in the range from 0.5 to 30 A/dm$^2$.

The reason is not clear why the excellent hydrogen overvoltage characteristics of the present invention are attained. Presumably, it results from the fine crystal structure or the amorphous structure of the electrodeposit formed by the process of the present invention in view of the very broad X-ray diffraction pattern thereof. The organic compound is considered to be effective in fining the crystal structure by inhibiting crystal growth in the electrodeposition process by complex formation with the metal ions or adsorption onto the electroconductive base material in the plating bath, or by incorporation of the organic compound itself at least partly into the electrodeposit film to cause distortion of the crystal.

It was confirmed by the inventors of the present invention that the hydrogen overvoltage characteristics depends also on the metal composition of the electrodeposit. For instance, as shown in Examples, an electrodeposit formed from the plating bath with nickel ions and iron ions of the present invention exhibits somewhat more excellent hydrogen overvoltage characteristics in the iron content range from 0.5% to 62.5% by weight than the one prepared in the plating bath containing only nickel ions. The electrodeposit produced from a plating bath containing nickel ions and indium ions of the present invention gives low hydrogen overvoltage in the indium content range from 1 to 90% by weight. At an indium content lower than this range, the hydrogen overvoltage is in the same level as that prepared in a plating bath containing only nickel of the present invention, whereas at an indium content higher than the above range the hydrogen overvoltage is higher. Presumably, crystal deformation caused by coprecipitation of different kinds of ions would be effective further in fining the crystal structure.

The present invention is described below more specifically without limiting the invention thereby in any way.

EXAMPLE 1

A plating bath was prepared by dissolving nickel chloride hexahydrate (1.00 mol/L), triammonium citrate (0.3 mol/L), and lysine (2.0 mol/L) in water, and adjusting the pH to 5 by addition of aqueous 28% ammonia. The electrode base material employed was a nickel mesh (short axis length: 4 mm, long axis length: 8 mm) having been degreased by alcohol and etched by nitric acid. The counter electrode was a nickel plate. The electrode was prepared by electroplating the electrode base material in a plating bath controlled at 60° C. at a plating current density of 10 A/dm$^2$ with an electricity quantity of 562 coulombs to form electrodeposit on the electrode base material. The electrodeposit contained carbon at a content of 9.8% by weight according to X-ray microanalysis. Electrolysis was conducted with this electrode with aqueous 32.5% sodium hydroxide solution at 90° C. at a current density of 40 A/dm$^2$. The hydrogen overvoltage was 110 mV.

EXAMPLES 2–4

An electrode was prepared in the same manner as in Example 1 except that the lysine in Example 1 was replaced by glycine, a-alanine, or arginine. The carbon content and the hydrogen overvoltage of the respective electrode was measured in the same manner as in Example 1.

EXAMPLE 5

A plating bath was prepared by dissolving nickel chloride hexahydrate (0.10 mol/L), triammonium citrate (0.6 mol/L), and azelaic acid (0.05 mol/L) in water, and adjusting the pH to 5 by addition of aqueous 28% ammonia. The electrode base material employed was a nickel plate (10 mm in diameter) having been degreased by alcohol and etched by nitric acid. The counter electrode was a platinum plate. An electrode was prepared by electroplating the electrode base material in a plating bath controlled at 55° C. at a plating current density of 1 A/dm$^2$ with an electricity quantity of 100 coulombs to form electrodeposit on the electrode base material. The electrodeposit contained carbon at a content of 3.9% by weight according to X-ray microanalysis. Electrolysis was conducted with this electrode with aqueous 32.5% sodium hydroxide solution at 90° C. at a current density of 40 A/dm$^2$. The hydrogen overvoltage was 180 mV.

EXAMPLE 6

A plating bath was prepared by dissolving nickel chloride hexahydrate (0.10 mol/L), triammonium citrate (0.6 mol/L), and propionic acid (0.1 mol/L) in water, and adjusting the pH to 4 by addition of aqueous 28% ammonia. The electrode base material employed was a nickel plate (10 mm in diameter) having been degreased by alcohol and etched by nitric acid. The counter electrode was a platinum plate. An electrode was prepared by electroplating the electrode base material in a plating bath controlled at 60° C. at a plating current density of 1 A/dm$^2$ with an electricity quantity of 85 coulombs to form electrodeposit on the electrode base material. The electrodeposit contained carbon at a content of 0.7% by weight according to X-ray microanalysis. Electrolysis was conducted with this electrode with aqueous 32.5% sodium hydroxide solution at 90° C. at a current density of 40 A/dm$^2$. The hydrogen overvoltage was 175 mV.

EXAMPLE 7

A plating bath was prepared by dissolving nickel chloride hexahydrate (1.00 mol/L), triammonium citrate (0.3 mol/L), and hexylamine (0.5 mol/L) in water, and adjusting the pH to 4 by addition of concentrated hydrochloric acid. The electrode base material employed was a nickel mesh (short axis length: 4 mm, long axis length: 8 mm) having been degreased by alcohol and etched by nitric acid. The counter electrode was a nickel plate. The electrode was prepared by electroplating the electrode base material in a plating bath controlled at 60° C. at a plating current density of 10 A/dm$^2$ with an electricity quantity of 840 coulombs to form electrodeposit on the electrode base material. The electrodeposit contained carbon at a content of 2.7% by weight according to X-ray microanalysis. Electrolysis was conducted with this electrode with aqueous 32.5% sodium hydroxide solution at 90° C. at a current density of 40 A/dm$^2$. The hydrogen overvoltage was 105 mV.

EXAMPLES 8–13

An electrode was prepared in the same manner as in Example 7 except that the hexylamine in Example 7 was replaced respectively by butylamine, cyclohexylamine, ethylenediamine, diethylenetriamine, triethylenetetramine, or hexamethylenediamine. The carbon content and the hydrogen overvoltage of the electrode was measured in the same manner as in Example 7.

EXAMPLE 14

A plating bath was prepared by dissolving nickel chloride (1.0 mol/L), disodium hydrogen citrate (0.3 mol/L), and lysine (0.5 mol/L) in water, and adjusting the pH to 4 by addition of aqueous 28% ammonia. The electrode base material employed was a nickel plate (10 mm in diameter) having been degreased by alcohol and etched by nitric acid. The counter electrode was a nickel plate. An electrode was prepared by electroplating the electrode base material in a plating bath controlled at 60° C. at a plating current density of 5 A/dm$^2$ for 120 minutes to form electrodeposit on the electrode base material. This electrode showed the initial hydrogen overvoltage of 148 mV in aqueous 32.5% sodium hydroxide solution at 90° C. at a current density of 40 A/dm$^2$. After conducting electrolysis in aqueous 32.5% sodium hydroxide solution at 90° C. at a current density of 50 A/dm$^2$ for 300 hours, the hydrogen overvoltage becomes higher by 10 mV than the initial hydrogen overvoltage.

Comparative Example 1

A plating bath was prepared by dissolving nickel chloride hexahydrate (1.00 mol/L), and triammonium citrate (0.3 mol/L), and adjusting the pH to 5 by addition of aqueous 28% ammonia. The electrode base material employed was a nickel plate (10 mm in diameter) having been degreased by alcohol and etched by nitric acid. The counter electrode was a nickel plate. An electrode was prepared by electroplating the electrode base material in a plating bath controlled at 60° C. at a plating current density of 10 A/dm$^2$ with an electricity quantity of 840 coulombs to form electrodeposit on the electrode base material. The electrodeposit contained carbon at a content of 0.3% by weight according to X-ray microanalysis. Electrolysis was conducted with this electrode with aqueous 32.5% sodium hydroxide solution at 90° C. at a current density of 40 A/dm$^2$. The hydrogen overvoltage was 370 mV.

Comparative Example 2

Electrolysis was conducted with nickel plates (10 mm in diameter) having been degreased by alcohol and etched by nitric acid in aqueous 32.5% sodium hydroxide solution at 90° C. at a current density of 40 A/dm$^2$. The hydrogen overvoltage was 420 mV.

Table 1 shows the results of Example 1–14 and Comparative Examples 1–2.

EXAMPLE 15

A plating bath was prepared by dissolving nickel chloride hexahydrate (1.00 mol/L), ferrous chloride tetrahydrate (0.05 mol/L), diammonium hydrogen citrate (0.3 mol/L), and hexylamine (0.2 mol/L) in water, and adjusting the pH to 4 by addition of aqueous 28% ammonia. The electrode base material employed was a nickel mesh (short axis length: 4 mm, long axis length: 8 mm) having been degreased by alcohol and etched by nitric acid. The counter electrode was a nickel plate. The electrode was prepared by electroplating the electrode base material in a plating bath controlled at 55° C. at a plating current density of 5 A/dm$^2$ with an electricity quantity of 562 coulombs to form electrodeposit on the electrode base material. The electrodeposit contained carbon at a content of 5.7% by weight and iron at a content of 26.0% by weight according to X-ray microanalysis. Electrolysis was conducted with this electrode with aqueous 32.5% sodium hydroxide solution at 90° C. at a current density of 40 A/dm$^2$. The hydrogen overvoltage was 95 mV.

EXAMPLES 16–19

An electrode was prepared and the carbon content, the iron content, and the hydrogen overvoltage were measured in the same manner as in Example 15 except that the concentration of the ferrous chloride was changed respectively to 0.001 mol/L, 0.005 mol/L, 0.02 mol/L, or 0.1 mol/L.

EXAMPLE 20

A plating bath was prepared by dissolving nickel chloride hexahydrate (1.00 mol/L), ferrous chloride tetrahydrate (0.1 mol/L), diammonium hydrogen citrate (0.3 mol/L), and lysine (0.5 mol/L) in water, and adjusting the pH to 4 by addition of aqueous 28% ammonia. The electrode base material employed was a nickel mesh (short axis length: 4 mm, long axis length: 8 mm) having been degreased by alcohol and etched by nitric acid. The counter electrode was a nickel plate. The electrode was prepared by electroplating the electrode base material in a plating bath controlled at 55° C. at a plating current density of 5 A/dm$^2$ with an electricity quantity of 562 coulombs to form electrodeposit on the electrode base material. The electrodeposit contained carbon at a content of 8.4% by weight and iron at a content of 27.0% by weight according to X-ray microanalysis. Electrolysis was conducted with this electrode with aqueous 32.5% sodium hydroxide solution at 90° C. at a current density of 40 A/dm$^2$. The hydrogen overvoltage was 101 mV.

EXAMPLES 21–26

An electrode was prepared and the carbon content, the iron content, and the hydrogen overvoltage were measured in the same manner as in Example 20 except that the concentration of the ferrous chloride was changed respectively to 0.01 mol/L, 0.02 mol/L, 0.05 mol/L, 0.2 mol/L, 0.3 mol/L, or 0.5 mol/L.

EXAMPLE 27

A plating bath was prepared by dissolving nickel chloride hexahydrate (1.0 mol/L), ferrous chloride tetrahydrate (0.2 mol/L), ammonium chloride (1.5 mol/L), and lysine (0.5 mol/L) in water, and adjusting the pH to 4 by addition of aqueous 28% ammonia. The electrode base material employed was a nickel mesh (short axis length: 4 mm, long axis length: 8 mm) having been degreased by alcohol and etched by nitric acid. The counter electrode was a nickel plate. The electrode was prepared by electroplating the electrode base material in a plating bath controlled at 60° C. at a plating current density of 5 A/dm$^2$ with an electricity quantity of 562 coulombs to form electrodeposit on the electrode base material. The electrodeposit contained carbon at a content of 4.2% by weight and iron at a content of 27.9% by weight according to X-ray microanalysis. Electrolysis was conducted with this electrode with aqueous 32.5% sodium hydroxide solution at 90° C. at a current density of 40 A/dm$^2$. The hydrogen overvoltage was 108 mV.

Comparative Example 3

A plating bath was prepared by dissolving nickel chloride hexahydrate (1.00 mol/L), ferrous chloride tetrahydrate (0.1 mol/L), and diammonium hydrogen citrate (0.3 mol/L) in water, and adjusting the pH to 4 by addition of aqueous 28% ammonia. The electrode base material employed was a nickel mesh (short axis length: 4 mm, long axis length: 8 mm) having been degreased by alcohol and etched by nitric acid. The counter electrode was a nickel plate. The electrode was prepared by electroplating the electrode base material in a plating bath controlled at 60° C. at a plating current density of 5 A/dm$^2$ with an electricity quantity of 562 coulombs to form electrodeposit on the electrode base material. The electrodeposit contained carbon at a content of 0.3% by weight and iron at a content of 25.0% by weight according to X-ray microanalysis. Electrolysis was conducted with this electrode with aqueous 32.5% sodium hydroxide solution at 90° C. at a current density of 40 A/dm$^2$. The hydrogen overvoltage was 210 mV.

Table 2 shows collectively the results of Examples 15–17 and Comparative Example 3.

EXAMPLE 28

A plating bath was prepared by dissolving nickel chloride hexahydrate (2.0 mol/L), cobalt chloride hexahydrate (0.05 mol/L), diammonium citrate (0.3 mol/L), and hexylamine (0.15 mol/L) in water, and adjusting the pH to 4 by addition of aqueous 28% ammonia. The electrode base material employed was a nickel mesh (short axis length: 4 mm, long axis length: 8 mm) having been degreased by alcohol and etched by nitric acid. The counter electrode was a nickel plate. The electrode was prepared by electroplating the electrode base material in a plating bath controlled at 60° C. at a plating current density of 5 A/dm$^2$ with an electricity quantity of 562 coulombs to form electrodeposit on the electrode base material. The electrodeposit contained carbon at a content of 1.8% by weight and iron at a content of 22.3% by weight according to X-ray microanalysis. Electrolysis was conducted with this electrode with aqueous 32.5% sodium hydroxide solution at 90° C. at a current density of 40 A/dm$^2$. The hydrogen overvoltage was 110 mV.

Comparative Example 4

A plating bath was prepared by dissolving nickel chloride hexahydrate (2.0 mol/L), cobalt chloride hexahydrate (0.05 mol/L), and diammonium citrate (0.3 mol/L) in water, and adjusting the pH to 4 by addition of aqueous 28% ammonia. The electrode base material employed was a nickel mesh (short axis length: 4 mm, long axis length: 8 mm) having been degreased by alcohol and etched by nitric acid. The counter electrode was a nickel plate. The electrode was prepared by electroplating the electrode base material in a plating bath controlled at 60° C. at a plating current density of 5 A/dm$^2$ with an electricity quantity of 562 coulombs to form electrodeposit on the electrode base material. The electrodeposit contained carbon at a content of 0.3% by weight and iron at a content of 21.2% by weight according to X-ray microanalysis. Electrolysis was conducted with this electrode with aqueous 32.5% sodium hydroxide solution at 90° C. at a current density of 40 A/dm$^2$. The hydrogen overvoltage was 220 mV.

EXAMPLE 29

A plating bath was prepared by dissolving nickel chloride (1.0 mol/L), indium sulfate (0.04 mol/L), disodium hydrogen citrate (0.3 mol/L), and lysine (0.5 mol/L) in water, and adjusting the pH to 4 by addition of aqueous 28% ammonia. The electrode base material employed was a nickel plate (10 mm in diameter) having been degreased by alcohol and etched by nitric acid. The counter electrode was a nickel plate. An electrode was prepared by electroplating the electrode base material in a plating bath controlled at 60° C. at a plating current density of 5 A/dm$^2$ for 120 minutes to form electrodeposit on the electrode base material. The carbon content and the indium content in the electrodeposit were measured by X-ray microanalysis. The initial hydrogen overvoltage of the resulting electrode was measured in aqueous 32.5% sodium hydroxide solution at 90° C. at a current density of 40 A/dm$^2$. After conducting electrolysis for 700 hours in aqueous 32.5% sodium hydroxide solution at 90° C. at a current density of 50 A/dm$^2$, the hydrogen overvoltage did not change.

EXAMPLES 30–31

Experiment were conducted respectively in the same manner as in Example 29 except that the indium concentration was changed to 0.01 mol/L or 0.1 mol/L.

EXAMPLE 32

A plating bath was prepared by dissolving nickel chloride (1.0 mol/L), indium sulfate (0.01 mol/L), disodium hydrogen citrate (0.3 mol/L), and hexylamine (0.2 mol/L) in water, and adjusting the pH to 4 by addition of aqueous 28% ammonia. The electrode base material employed was a nickel plate (10 mm in diameter) having been degreased by alcohol and etched by nitric acid. The counter electrode was a nickel plate. An electrode was prepared by electroplating the electrode base material in a plating bath controlled at 60° C. at a plating current density of 5 A/dm$^2$ for 120 minutes to form electrodeposit on the electrode base material. The carbon content and the indium content in the electrodeposit were measured by X-ray microanalysis. The initial hydrogen overvoltage of the resulting electrode was measured in aqueous 32.5% sodium hydroxide solution at 90° C. at a current density of 40 A/dm$^2$.

EXAMPLES 33–36

Experiment were conducted respectively in the same manner as in Example 32 except that the indium sulfate concentration was changed to 0.001 mol/L, 0.005 mol/L, 0.04 mol/L, or 0.1 mol/L.

Table 3 shows the results of Examples 29–36 and Comparative Example 5.

A plating bath was prepared by dissolving nickel chloride (1.0 mol/L), indium sulfate (0.5 mol/L), disodium hydrogen citrate (0.3 mol/L) and hexylamine (0.2 mol/L) in water, and adjusting the pH to 4 by addition of aqueous 28% ammonia. The electrode base material employed was a nickel plate (10 mm in diameter) having been degreased by alcohol and etched by nitric acid. The counter electrode was a nickel plate. An electrode was prepared by electroplating the electrode base material in a plating bath controlled at 60° C. at a plating current density of 5 A/dm$^2$ for 120 minutes to from electrodeposit on the electrode base material. The indium content in the electrodeposit measured by X-ray microanalyzer was 95.0 wt %, The initial hydrogen overvoltage of the resulting electrode was measured in aqueous 32.5% sodium hydroxide solution at 90° C. at a current density of 40A/dm$^2$.

TABLE 1

| | Organic compound | | Plating | Carbon | |
|---|---|---|---|---|---|
| | Compound | Concentration in plating bath (mol/L) | current density (A/dm$^2$) | content in electrodeposit (weight %) | Hydrogen overvoltage (mV) |
| Example | | | | | |
| 1 | Lysine | 2.0 | 10 | 9.8 | 110 |
| 2 | Glycine | 2.0 | 10 | 3.0 | 168 |
| 3 | α-Alanine | 2.0 | 10 | 3.5 | 160 |
| 4 | Arginine | 2.0 | 10 | 6.5 | 116 |
| 5 | Azeraic acid | 0.05 | 1 | 3.9 | 180 |
| 6 | Propionic acid | 0.1 | 1 | 0.7 | 175 |
| 7 | Hexylamine | 0.5 | 10 | 2.7 | 105 |
| 8 | Butylamine | 0.5 | 10 | 6.6 | 175 |
| 9 | Cyclohexylamine | 0.5 | 10 | 4.2 | 161 |
| 10 | Ethylenediamine | 0.5 | 10 | 5.0 | 148 |
| 11 | Diethylenetriamine | 0.5 | 10 | 5.4 | 142 |
| 12 | Triethylenetetramine | 0.5 | 10 | 5.6 | 178 |
| 13 | Hexamethylenediamine | 0.5 | 10 | 3.5 | 179 |
| 14 | Lysine | 0.5 | 5 | 4.8 | 148 |
| Comparative Example | | | | | |
| 1 | None | | 10 | 0.3 | 370 |
| 2 | Ni base material only, not plated | | | | 420 |

TABLE 2

| | Organic compound | Carbon content in electrodeposit (weight %) | Iron content in electrodeposit (weight %) | Hydrogen over-voltage (mV) |
|---|---|---|---|---|
| Example | | | | |
| 15 | Hexylamine | 5.7 | 26.0 | 95 |
| 16 | Hexylamine | 6.8 | 0.5 | 98 |
| 17 | Hexylamine | 16.5 | 3.6 | 97 |
| 18 | Hexylamine | 11.1 | 13.2 | 99 |
| 19 | Hexylamine | 4.2 | 39.1 | 103 |
| 20 | Lysine | 8.4 | 27.0 | 101 |
| 21 | Lysine | 9.9 | 5.2 | 109 |
| 22 | Lysine | 8.7 | 10.1 | 108 |
| 23 | Lysine | 8.6 | 19.2 | 107 |
| 24 | Lysine | 12.8 | 38.1 | 102 |
| 25 | Lysine | 2.4 | 50.3 | 103 |
| 26 | Lysine | 8.1 | 62.5 | 109 |
| 27 | Lysine | 4.2 | 27.9 | 108 |
| Comparative Example | | | | |
| 3 | None | 0.3 | 25.0 | 210 |

TABLE 3

| | Carbon content in electrodeposit (weight %) | Indium content in electrodeposit (weight %) | Initial hydrogen overvoltage (mV) |
|---|---|---|---|
| Example | | | |
| 29 | 3.3 | 26.3 | 111 |
| 30 | 5.1 | 11.5 | 137 |
| 31 | 2.5 | 42.0 | 123 |
| 32 | 5.7 | 16.6 | 90 |
| 33 | 5.9 | 2.2 | 99 |
| 34 | 2.6 | 10.6 | 94 |

TABLE 3-continued

| | Carbon content in electrodeposit (weight %) | Indium content in electrodeposit (weight %) | Initial hydrogen overvoltage (mV) |
|---|---|---|---|
| 35 | 4.3 | 62.6 | 95 |
| 36 | 2.1 | 85.4 | 103 |
| Comparative Example | | | |
| 5 | — | 95.0 | 300 |

What is claimed is:

1. A low hydrogen overvoltage cathode comprising an electroconductive base material; and a coating layer containing at least one organic compound selected from the group consisting of amino acids, monocarboxylic acids, dicarboxylic acids, monoamines, diamines, triamines, and tetramines, and derivatives thereof at a content of from 0.5% to 18% by weight in terms of carbon, and a metal component selected from the group consisting of nickel-iron, nickel-cobalt, and nickel-indium at an indium content ranging from 1% to 90% by weight.

2. The cathode set forth in claim 1, wherein the electroconductive base material is selected from the group consisting of nickel, iron, copper, titanium and stainless steel.

3. The cathode set forth in claim 1, wherein a thickness of the coating layer is in a range from 20 to 300 $\mu$m.

4. The cathode set forth in claim 1, wherein the coating layer has an amorphous crystal structure.

5. The cathode set forth in claim 1, wherein the metal component is nickel-iron, and an iron content in the coating layer is in a range from 0.5% to 62.5% by weight.

6. The cathode set forth in claim 1, wherein the content of the organic compound is in a range from 5% to 18% by weight in terms of carbon.

7. A process comprising using the cathode set forth in claim 1 for electrolysis of water, or electrolysis of an alkali metal chloride.

8. The process set forth in claim 7, wherein said alkali metal chloride is sodium chloride.

9. A process for producing the low hydrogen overvoltage cathode set forth in claim 1, comprising conducting electrodeposition to form a coating layer on a surface of an electroconductive base material in a plating bath containing at least nickel and iron ions, nickel and cobalt ions, or nickel and indium ions, and containing additionally at least one organic compound selected from the group consisting of amino acids, monocarboxylic acids, dicarboxylic acids, monoamines, diamines, triamines, and tetramines, and derivatives thereof.

10. The process set forth in claim 5, wherein the organic compound is used in an amount within a range of from 0.1 to 3 moles per mole of nickel ion in the plating bath.

11. The process set forth in claim 5, wherein a temperature of the plating bath is in a range from 20° C. to 80° C.

12. The process set forth in claim 5, wherein the electrodeposition is conducted so that a plating current density is in a range from 0.5 to 30 A/dm$^2$.

* * * * *